United States Patent [19]

Crump, Jr.

[11] 4,312,532

[45] Jan. 26, 1982

[54] DEVICE FOR CARRYING AND SECURING SKIS, BOOTS AND POLES AND PROCESS FOR USE

[76] Inventor: John M. Crump, Jr., 1018 Parkridge Cir. W., Jacksonville, Fla. 32211

[21] Appl. No.: 57,306

[22] Filed: Jul. 13, 1979

[51] Int. Cl.[3] ..... A45F 5/10

[52] U.S. Cl. ..... 294/147; 294/163; 294/165

[58] Field of Search ..... 224/917, 45 R, 45 S; 280/814; 12/120.5; 211/34, 37, 60 SK; 294/34, 87 R, 87.2, 103 R, 147, 163, 165

[56] References Cited

U.S. PATENT DOCUMENTS

| | | | |
|---|---|---|---|
| 3,074,085 | 1/1963 | Salzman | 224/45 S |
| 3,259,284 | 7/1966 | Olson | 224/45 S |
| 3,260,430 | 7/1966 | Sandenburgh | 224/45 S |
| 3,272,413 | 9/1966 | Pfleider | 224/45 S |
| 3,414,311 | 12/1968 | Trimboli | 294/34 |
| 3,718,842 | 2/1973 | Larson | 224/45 S |
| 3,917,137 | 11/1975 | Wilkins | 224/917 |
| 4,114,915 | 9/1978 | Lello et al. | 224/45 S |
| 4,126,255 | 11/1978 | Olson | 224/45 S |

*Primary Examiner*—Steven M. Pollard

[57] ABSTRACT

The invention is a single, integral device for carrying and securing any desired combination of equipment such as skis, boots and poles. The device includes a pair of cooperable body members one of which is contoured to receive skis and poles in the lower part of the body. A vertical stem section and upper body member provides for boot attachment and a hand grasp handle for holding the device during carrying. The basic configuration provides in one device the means for carrying skis, poles and boots. The invention has the additional novel feature of providing simultaneous means for securing, with one lock, any combination of ski equipment including skis, poles and boots. The unique physical relationship of the skis, poles and boots, while attached to the device, provides a stable, streamlined and beneficial center of gravity highly conducive to user safety and compact storage.

29 Claims, 17 Drawing Figures

DEVICE FOR CARRYING AND SECURING SKIS, BOOTS AND POLES AND PROCESS FOR USE

BACKGROUND OF THE INVENTION

1. Field of the Invention

The present invention consists of a device for carrying any combination of equipment such as skis, poles and boots while simultaneously providing a single, integral means for securing the complete device and any combination of equipment when a skier leaves them unattended in a ski resort area.

2. Description of the Prior Art

The conventional techniques for carrying and handling ski equipment encompasses a wide range of diverse, cumbersome, awkward and clumsy combinations of positions relative to the skiers capacity for maintaining a hand grasp onto the unwielding equipment. Transporting, carrying and securing this expensive equipment entails considerable effort and time. The environmental setting of a ski resort area requires the handling of ski equipment over considerable distance usually covered with snow and ice creating a dangerous situation to both the skier and persons nearby. The manner in which the skier is attempting to carrying the equipment can in fact increase the danger and hazards, particularly if the skis are on the skiers shoulder and the boots are in the other hand. In this case, the dangers are for both skier and other people since a slip on the ice will cause the skier to actually throw the skis and strike nearby persons thereby causing severe injuries. Each time a skier takes a refreshment break from skiing and removes his skis he must guard against possible theft. There are never adequate, functioning, means provided at ski resorts to accomodate all skiers.

There are no known single devices which will simultaneously provide in one integral device the means for both carrying and securing any combination of skis, poles and boots. Furthermore, there is no known device for accomplishing the above and also not subjecting the equipment to unnecessary bending forces.

A device for carrying and securing skis and poles has been disclosed, for example, in U.S. Pat. No. 3,990,655 by Covell. A device for carrying boots has been disclosed in U.S. Pat. No. 3,210,787 by Allsop. These prior devices are limited to their independent uses.

Therefore, there is a definite need for a single, integral device which will accomplish both carry and security means for not only skis and poles but skis, poles and boots or any combination thereof.

OBJECTS AND SUMMARY OF THE INVENTION

The carrying device of the present invention has among its objectives the remedying in a single economical design the defects and/or disadvantages of prior devices including those just noted above. It has the desirable characteristic of being easily loaded, locked and unloaded. It embodies two basic parts only, including a combination hand grasp and boot size adjustment member which is arranged to provide hand grasp carry means and has integral boot binding means, the lower main body portion of the assembly being contoured to house the skis and poles, the boots cooperating with the skis, poles and main body part to form an assembly whereby one lock can be utilized for securing the complete set of equipment. Furthermore, the device can be utilized to carry and secure the skis and poles without the boots or the boots without the skis and poles.

Formed integrally with the main body part is an arrangement of contoured receiving chambers, boot heel and toe lugs shaped and related to each other in such a manner as to insure in cooperation with the boot toe retainer that the boots, poles and skis are normally held in position and free of looseness. By hand adjustment of the appropriate member, the equipment may be easily removed and/or replaced onto the carrying device. In this connection the boot toe retainer is made adjustable and related to the hand grasp such as to maintain pressure on the equipment to insure against looseness or accidental release. The arrangement is further adjustable to accommodate boots and skis of all sizes and will retain, carry and secure these in substantially the same reliable manner throughout the complete size range. Furthermore, the device will achieve this objective equally well with any combination of equipment.

The above objectives and advantages, and others as well, will be made more fully apparent from the considerations of preferred embodiments referenced in the following detailed description and contemplated in connection with the accompanying drawings in which like reference symbols generally designate like parts throughout the figures.

DESCRIPTION OF THE PREFERRED EMBODIMENTS

Figure 3:
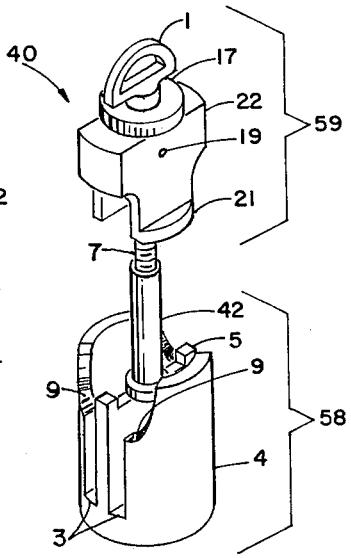
FIG. 3 is a perspective view of a device for carrying and securing skis, poles and boots shown in the extended position.

The preferred embodiments of present invention are best illustrated by reference to FIG. 6 wherein a device for carrying and securing skis, poles and boots is shown. The device 40, constructed of plastic materials includes a ski housing member 4 having dimensions M, a telescoping stem section 42 having variable dimension range of K and L, an adjustable boot toe retainer member 22 which can be adjusted to conform to any size J and K for boot or shoe 41 a security device, such as a cable lock, may be inserted through locking cable opening 19 thereby causing toe retainer 22 to be fixed against any further adjustment thus locking the boots 41, skis 6 and poles 10 together with device 40. FIG. 3 illustrates device 40 in its extended position without skis 6, poles 10 and boots 41.

Figure 4:
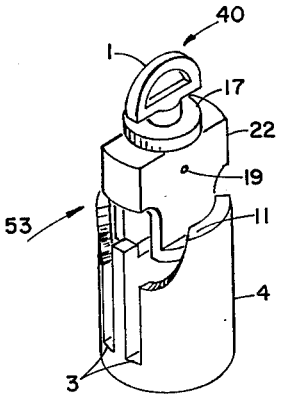
FIG. 4 is a perspective view of the device in FIG. 3 shown in the retracted position for carrying and securing skis and poles.

Further, additional versatility of the embodiment is illustrated in FIG. 4 where device 40 is shown in its retracted position for carrying and securing skis 6 and poles 10 without boots 41. The device as shown in FIG. 4 has form shown as generally cylindrical. However, a rectangular form may be substituted without affecting the novel features of the invention. The device 40 has a ski housing base member 4 with an adjustable stem section 7 disposed perpendicular therefrom and jointed at the mid portion of base member 4 with the opposite end of stem 7 coupled to a hand grasp 1. A wire locking cable (not shown) is passed through locking cable opening 19, and its ends joined by a combination lock, thereby allowing the device 40 to be securely anchored in place.

Although the preferred embodiments of the present invention are believed best constructed from plastic materials which can be molded, other embodiments of the invention can be formed from metals such as stainless steel or aluminum. The inventor's experience indicates that the use of a durable plastic would produce a more durable, lighter and economical device 40. A combination of materials is also entirely feasible and within the scope of this invention.

Figure 1:
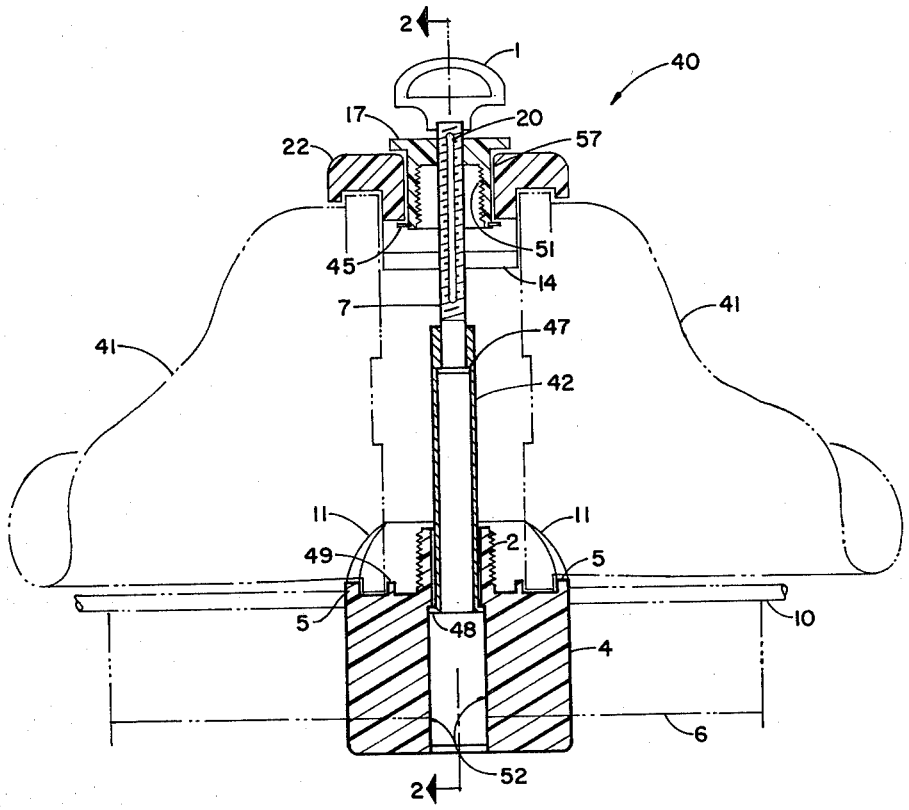
FIG 1 is a sectional view taken on the line 1—1 of FIG. 2.
Figure 5:
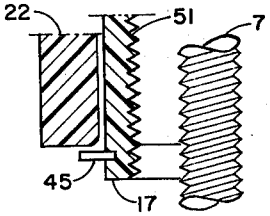
FIG. 5 is an enlarged cross sectional view showing retaining ring 45 of FIG. 2.

However, with reference to FIG. 1, it is apparent that the various parts can be made in different sizes or shapes depending upon the materials selected. Each material has its own peculiar manufacturing requirements and strength to size ratios. For example, if steel were to be used, a particular part may be circular in cross sections and suitable for "wireforming" manufacturing techniques. The same part made from plastic may well be rectangular in cross sections with reinforcing ribs to achieve corresponding strength to size ratios. The member 22 functions primarily as the boot retainer and may be referred to as such. It includes special adjustment features 7 generally midway between the top 11 of the ski housing 4 and the bottom of hand grasp 1. The boot heel retainer 5 defines a recess and provides a platform upon which the boots are mounted as shown for example in phantom lines in FIG. 1. The space below the platform 5 provides a ski and pole compartment as will be described hereinafter. The side walls 11 are curved generally to the boot heel and contoured with the inner vertical surfaces of the side walls 11 undercut or recessed to form pole chamber support ledges 14 for the purpose of pole support and retention (see FIG. 2). The side walls have been shown as smooth surfaces. However, depending upon the construction materials and manufacturing technique the configuration may include reinforcing ribs or wire formed skeletonized constructions.

The boot heel retainer 5 in combination with the configuration of side walls 11 provides means for applying small holding force down against the skis thereby causing compression pads 13 to yield and accommodate various size skis. Pole compression pads 14 are provided in the pole receiving chambers 9 for substantially the same purpose.

While the intended use of this device 40 would imply plastic as the best suited material, it is fully contemplated that this invention may be constructed utilizing a variety of materials or combinations thereof. It is for this reason, together with consumer preference considerations, that the adjustable boot toe retainer 22 and telescoping stem means 42 may be constructed in a wide variety of modified arrangements. Each class of arrangement will be described hereinafter including certain particular details unique thereto.

For purposes of clarity and ease of description, the overall device 40 construction in a typical preferred embodiment will first be described, then the particular subassemblies involved with the modified arrangements including certain necessary particulars of various elements thereof, and finally followed by a description of various advantages achieved by device 40 over prior devices of record.

Referring in detail to FIG. 1 there is shown a method of assemblying objects 1, 10 and 41 into removable retention with device 40 by means of cooperable body members symmetrically related and oppositely disposed with respect to centrally located telescopic stems 7 and 42. Adjusting and locking means 17 is rotatably connected to boot toe retainers 22 and threadably engaged with stem 7 such that manipulation of means 17 causes retainers 22 to be adjusted upward or downward to accomodate various sizes of objects 41. FIGS. 2, 3, 4, 5, 6, 7 and 8 further illustrate the multi-functional features of member 17 including the engagement of internal threads 51 with mid-body 2 thus providing device 53 for carrying objects 6 and 10 without objects 41.

Figure 2:
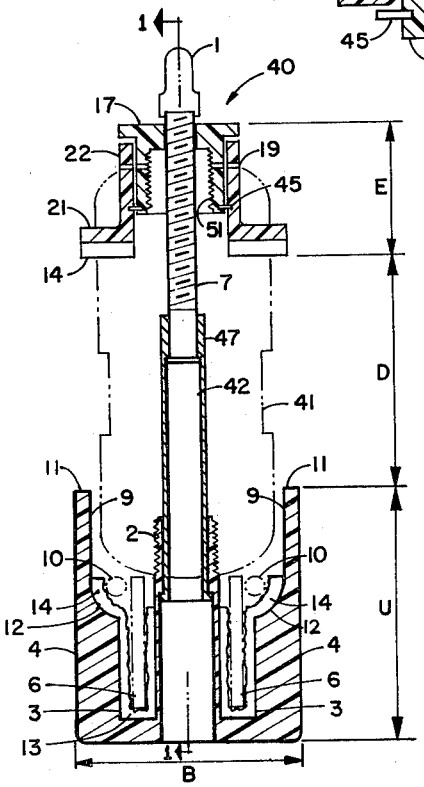
FIG. 2 is a sectional view taken on the line 2—2 of FIG. 1.

The lower end of telescoping stem section 42 is slidably joined with ski housing member 4 and generally located concentric therewith as shown in FIGS. 1, 2 and 3. It will be understood and appreciated that the cylindrical body diameter of stem section 7 is somewhat smaller than the upper internal diameter of telescoping stem section 42. Observe that stem extension limit means 47, generally comprised of a slightly enlarged diameter relative to stem body 7 and somewhat smaller than the lower internal diameter of telescoping stem section 42, establishes the uppermost extended position of stem section 7. Furthermore, substantially the same construction applies to the lower end of telescoping stem section 42 relative to mid-body member 2. Observe that stem extension limit means 48 establishes the uppermost extended position of stem section 42. Stem extension limit means 47 and 48, shown in FIGS. 1, 2, 7, 8 and 9 may be configured to function in longitudinal keyways thereby allowing vertical movement and preventing rotational motion of stems 7 and 42. Thus as best seen in FIG. 2 dimension D may be adjusted to accomodate objects 41 by manipulation of adjusting and locking means 17. Furthermore, observe in FIG. 1 that hand grasp 1 may be fixed to stem 7 such that stem 7 may be rotated while restraining means 17 thereby causing retainers 22 to be adjusted upward or downward.

Skis 6, poles 10 and boots 41 are seen in FIG. 2 according to typically characteristic mounting relationship. Extending upwardly from, and formed integrally with ski housing 4, are a pair of upstanding, substantially similar, symmetrically disposed side walls 11. Said walls 11 having interior pole receiving chambers 9 contoured to receive therethrough poles 10. Extending longitudinally and formed integrally with ski housing 4, is a central upstanding wall designated by dimension A and extending parallel with skis 6. Said wall formed with a centrally located stem receiving chamber 52 substantially coextensive with upper mid-body projection 2. Pole receiving chambers 9 are provided with resilient or yieldable pad surfaces. Ski receiving chambers 3 are provided with similar resilient or yieldable pad surfaces. Dimensions A and B are selected to cooperate with boot configuration 41 and dimension C such that manual adjustment of adjusting and locking member 17 will cause toe retainer 22 to force the heel of boot 41 to secure poles 10 and skis 6 within device 40.

The boot toe retainer 22 is vertically axially communicated around the adjusting and locking member 17. Said member 17 rotatably engaged with stem section 7 and circumferentially enlarged at the top most section to form a surface for manual rotation of same. The lower section of member 17 is restrained vertically by the enlarged top section and retaining ring 45. As can be particularly seen in enlargement in FIG. 5. This retaining ring 45 is fixed to member 17 to allow free rotation of 17 relative to member 22 while preventing relative vertical motion. The interior hollow cylindrical cross section of member 17 being provided with threads for engagement with threaded section of mid-body 2 when the device 40 is utilized for poles 10 and skis 6 without boots 41 as illustrated by device 53 in FIGS. 4, 7, and 8.

Figure 6:
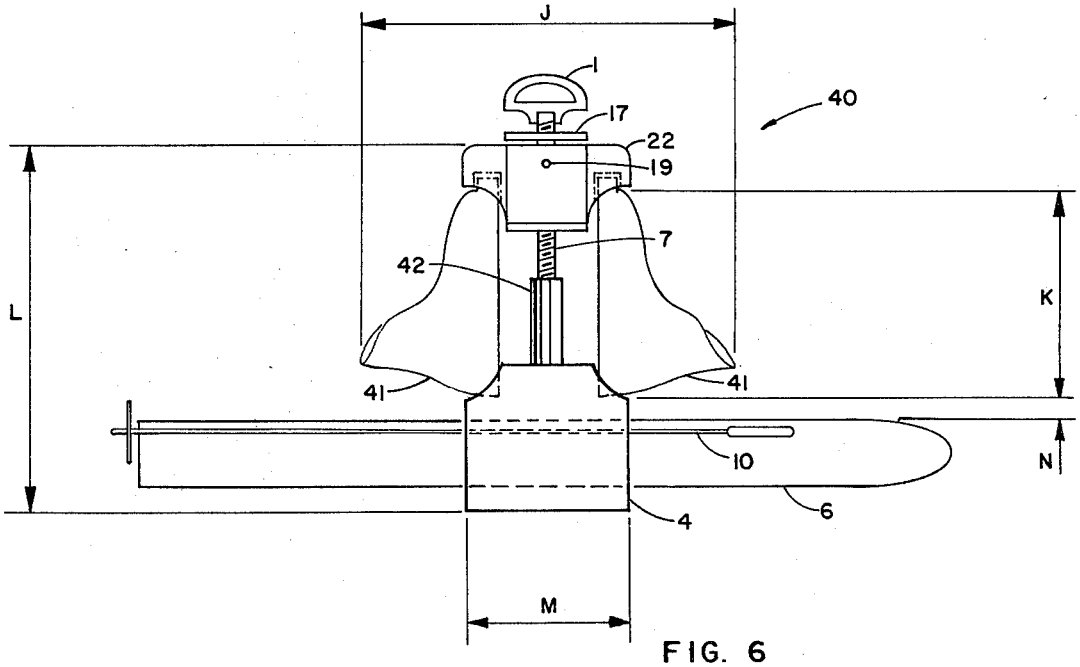
FIG. 6 is a side view of the device for carrying and securing skis, poles and boots.

As best seen in FIG. 6 the device 40 is shown in a typical usage posture including skis 6, poles 10 and boots 41. Observe that the device 40 has a unique geometric configuration, more particularly emphasized by dimensions J, K, L, M and N, resulting in streamline, compact, balanced, and convenient carrying characteristics. Carrying handle, or hand grasp 1, is contoured to fit the hand with adjusting and locking member 17 convenient for manual adjustment, locking cable opening 19 easily accessible, symmetrical balanced and providing in one single device the means for carrying and securing a complete set of ski equipment including boots 41, skis 6 and poles 10. FIG. 3 again illustrates device 40 without the boots 41, skis 6 and poles 10 installed therewith. It is instructive to point out that the boots may be installed with the toes and heels in a reversed position from that shown and this embodiment is considered fully acceptable within the intended usage of device 40.

As previously mentioned, the boots 41 are detachably secured to device 40 by boot toe retainer 22 which is adjustably engaged with stem section 7 by means of rotatable adjusting and locking member 17. Accordingly, it will be seen in FIGS. 7 and 8 that the device 40 shown in FIGS. 1, 2, 3, and 6, can be easily adjusted to a device 53 utilized primarily for carrying and securing skis 6 and poles 10 without boots 41. This is a particularly useful arrangement since there are many occasions where the user will find it highly desirable to wear boots 41 on his feet but carry and/or secure his skis 6 and poles 10.

Figure 7:
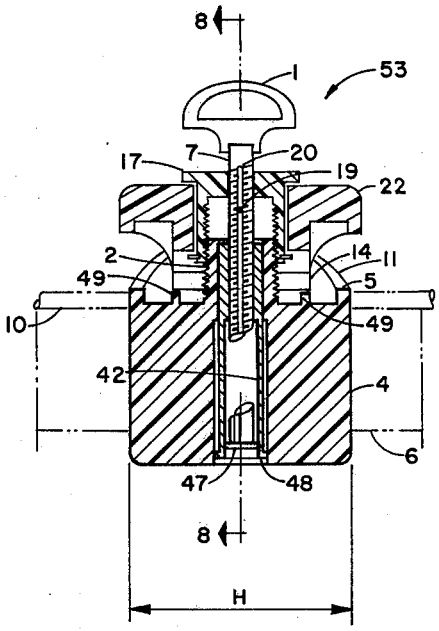
FIG. 7 is a cross sectional view of the device shown in FIG. 4.
Figure 8:
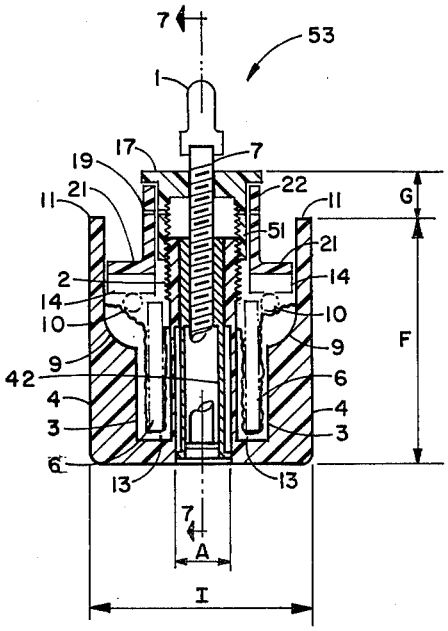
FIG. 8 is a cross sectional view taken on the line 8—8 of FIG. 7.

Thus, as best seen in FIGS. 7 and 8, a continuation of the downward telescoping of stem section 42 into mid-body chamber designated by dimension A combined with a continuation of the downward adjustment of member 17 relative to stem section 7. boot toe retainer 22 can be moved down into surface contact with top portions of skis 6 and poles 10. The upper central position of member 17 is provided with internal threads selected to engage mating threads on stem section 7 while the lower central portion of member 17 is counterbored slightly and provided with threads 51 selected to engage mating threads on mid-body section 2. Locking cable opening 19 is provided in members 17 and 22 cooperating with a locking slot 20 in stem section 7 whereby following the installation of a locking cable (not shown) the device 53 is secured along with its skis 6 and poles 10. Prior to insertion of a locking cable into opening 19 the pole compression pads 14 are compressed against poles 6 and skis 10 thereby automatically holding the skis and poles in their proper location within device 53. Yieldable or resilient means 13 may be provided along the periphery of ski chambers 3 thereby minimizing potential surface damage to skis and poles. Ski and pole retainer 21, shown in FIG. 8, form a partially circumferentially enlargment at the base of member 22 slightly smaller than the interior surface of side walls 11. This feature may also be observed in FIG. 3. Therefore, FIGS. 7, 8 and 4 disclose a device 53, whose configuration is achieved by simply lowering the stem section 7 and 42 of device 40 down into the mid-body section 2, for carrying and securing skis 6 and poles 10 exclusive of boots 41.

Figure 9:
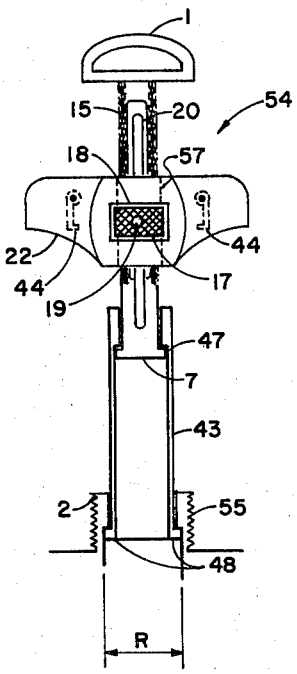
FIG. 9 is a cross sectional view showing an alternate means for adjusting the boot toe retainer.

Turning now to FIGS. 9 through 17 and to the features of various classes of adjusting and locking mechanisms 54, which are slightly modified forms of the related members shown in FIGS. 1, 2, 7 and 8, it will be seen that a variety of arrangements lend themselves for adaptation to carrying and securing devices 40 and 53. Referring in particular to FIG. 9, the mid-body section is shown having a raised or extended portion 2 with teeth 55 for cooperating with a pair of spring loaded pawls 44 pivotally mounted within toe retainer 22 and further provided with finger operating tabs (not shown). A receiving passage, designated by dimension R, providing for the slidably and telescoping mounting of cooperating stem section 43 and 7. The upper extension limits of each stem section being respectively restrained by limit means 47 and 48. Stem section 7, in this particular class of mechanism, has a generally rectangular cross section with two of its parallel sides 15 serrated, or threaded, to mate with cooperating threads located internal of adjusting and locking member 17. Preferably, the outer peripheral surface of the member 17 is knurled or roughened in order to facilitate manual rotation thereof. Member 17 is rotatably contained within horizontal passage 18. Member 22 is further provided with a vertical passage cooperating to allow passage of stem 7 therethrough. The entire mechanism is detachably secured to the housing mid-body 2 and this is accomplished by removing hand grasp 1 from stem 7 thereby allowing member 17 and 22 to be removed from stem 7 thus allowing stem section 7 and 43 to be lowered down through passage designated by dimension R. This of course makes for attractive manufacturing and assembling characteristics. The cooperative relationship between construction materials, structural strength and desirable dimensions R, T, O and P of FIGS. 9 through 12, will understandably influence the selection of size and shape for various elements. For instance, in FIGS. 10 and 11, it is desirable to keep dimension T as a minimum thereby providing minimum distance between skis 6 resulting in minimum dimension O. These design factors in turn influence dimension R of FIGS. 9 and 10. Accordingly this will influence the cross section of stems 43 and 7 to become rectanglar in shape as opposed to circular. Therefore those modifications achieved in the spirit of the foregoing discussion are considered inherently within the scope of the present invention. Continuing with reference to FIG. 9, there is a longitudinal slot 20 in stem 7 cooperating with locking openings 19, located circumferentially at 90 degrees, such that when a locking cable (not shown) is inserted through said opening 19 and slot 20 the device 54 is secured against further adjustment until said locking cable is removed.

Figure 11:
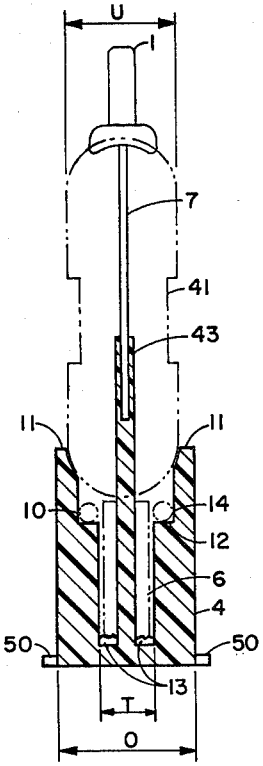
FIG. 11 is a section view showing alternate rectangular construction.
Figure 12:
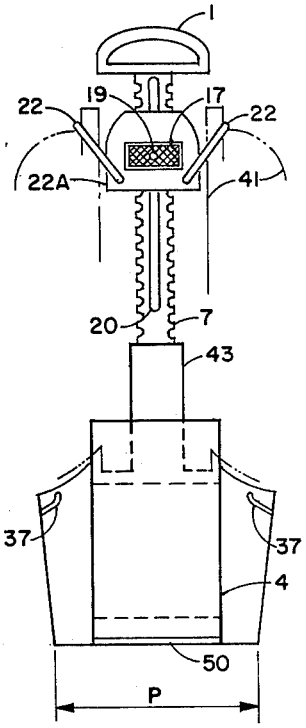
FIG. 12 is a side view showing alternate construction.
Figure 13:
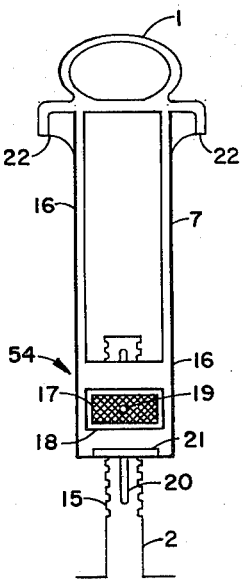
FIG. 13 is a partial side view showing alternate stem adjustment construction.

Referring now to FIGS. 11 and 12 observe that boot rack attachment members 50 may be formed integrally with and along the lower edges of ski housing 4. The entire lower portion of housing 4 may be configured to cooperate with ski shop sales racks (not shown) and/or rental shop storage racks (not shown). The device 40, under these conditions, would preferably be utilized to accommodate boots 41 exclusive of the skis 6 and poles 10. Extending outward from, and integral with housing 4, the tongue projections 50 are formed to provide a means of detachably mounting the device 40 or 53 onto sales or rental shop racks (not shown). The ski housing 4 may be further modified to include oppositely disposed mid-body boot heel support extensions 46 to achieve dimension P as illustrated in FIG. 12. Three related considerations influencing dimension P are boot heel support, ski lateral stability and structural integrity.

Figure 14:
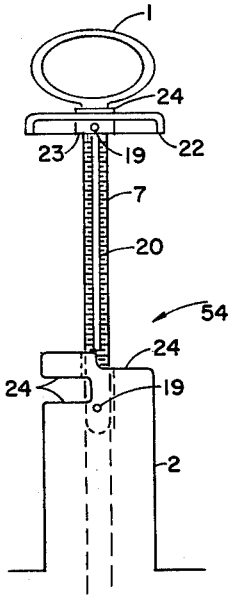
FIG. 14 is a partial side view showing alternate stem adjustment construction.
Figure 15:
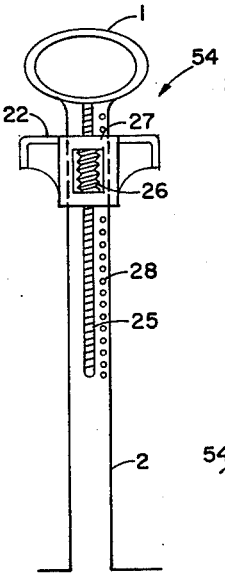
FIG. 15 is a partial side view showing alternate stem adjustment construction.
Figure 16:
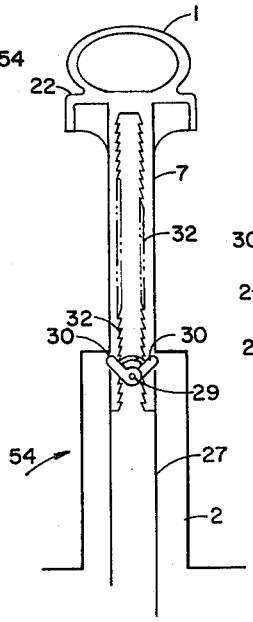
FIG. 16 is a partial side view showing alternate stem adjustment construction.
Figure 17:
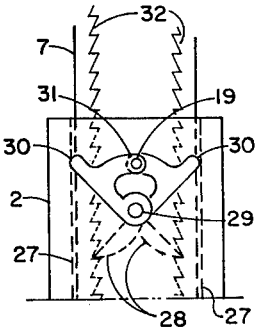
FIG. 17 enlarged view showing ratchet and pawl adjusting and locking mechanism.

Turning now to FIGS. 13 through 17 respectively, it will be seen that four additional general classes of adjusting mechanisms 54 have been illustrated. First, in FIG. 13, there is illustrated a mechanism similar to that shown in FIG. 9 except the stem 2 is non-telescoping. Second, in FIG. 14, there is shown an arrangement having a threaded stem 7 cooperating with a mid-body extension 2 whose upper end is provided with formed internal threaded sections at locations generally adjacent to 24. That is, the threads are formed into extension 2 during the molding process thereby eliminating the necessity for any further construction operations. Boot toe retainer 22 is generally circular and rotatably mounted onto stem 7. Locking cable opening 19 may be located optionally in member 22 or member 2 to cooperate with longitudinal slot 20. In FIG. 15 there is shown a third general class of adjusting mechanism having tooth rack 25 disposed longitudinal and integral with mid-body stem extension 2. Cooperating with rack 25 is externally threaded adjusting member 26 which is rotatably mounted in the side chamber recess of boot toe retainer 22. A series of locking cable openings 28 are provided along the side of member 2 and cooperating therewith is cable opening 27 located in the member 22. The heretobefore described resilient pads 13 will allow member 22 to be adjusted to align said opening 27 with one of openings 28 whereby a locking cable (not shown) can be inserted therewith for securing the device 54. In FIGS. 16 and 17 there is shown a fourth class of adjusting mechanism using ratchet and pawl techniques. FIG. 16 illustrates the relationship of the ratchet 32 to the pawls 30 and the downward telescoping of stem 7 into passage chamber 27 provided internal to mid-body extension 2. As best seen in FIG. 17, pawls 28 are pivotally mounted on double shaft 29, one internal to the other, with each pawl fixed to one of respective shafts which are supported by passage through side walls of member 2. A spring or resilient means (not shown) provides constant urging action to levers 30 whereby pawls 28 are biased into engagement with the surface of ratchet teeth 32. Thus as pressure is applied downward to hand grasp 1, the stem 7 telescopes into passage 27 thereby adjusting boot toe retainer 22 into the desired holding pressure, or force, contact with boots 41. The ratchet 32 and pawl 28 action automatically restrains stem 7 from reverse, or outward, movement until pawl levers 30 are manually moved simultaneously, one clockwise, the other counterclockwise, thereby releasing pawls 28 from engagement with ratchet teeth 32. Furthermore, a locking cable opening 19 is provided in member 31 and side wall of 2 whereby a locking cable (not shown) may be inserted for securing the device 54. It is apparent from the foregoing descriptions and discussions that the device 40 and 53, according to the principles of the present invention, may be provided with any one of the general classes of adjusting mechanisms 54, yet the device may be manufactured as a single and integral unit from suitable plastic materials.

Figure 10:
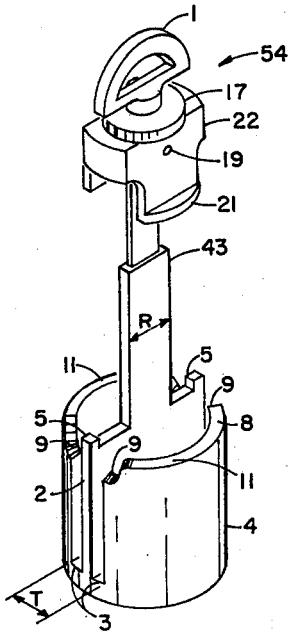
FIG. 10 is a perspective view of alternate rectangular stem construction.

Referring to FIGS. 10 and 11, observe that with a ski chamber dimension T slightly greater than boot dimension U the boot 41 heel can be lowered down into ski housing 4 thereby causing skis 6 to be positioned along the lower sides of boots 41, or in other words, the boots 41 nested between the skis 6. The advantage of this arrangement is best described in FIG. 6 by reference to dimension L which can be made shorter by an amount approximately three fourths of the ski 6 width. This arrangement would preferably be incorporated with boot heel support extensions 46 illustrated in FIG. 12. Observe alternate toe retainer means 22.

It is considered somewhat interesting to also note that in FIG. 6, boots 41 can be secured to device 40 with the heel and toe positions reversed. For stability reasons, it is apparent that the best condition is as shown in FIG. 6.

The following specific examples are illustrative of the nature of the present invention and having described the construction and relation of the parts in most respects, a description will be given of the operation and functioning of device 40 in a typical ski equipment utilization environment.

EXAMPLE 1

FIG. 4 illustrates device 40 as it may appear for shipping, sales display or storage during non usage and when in this posture called device 53.

EXAMPLE 2

FIG. 3 illustrates device 40 ready for installation of ski equipment. Member 17, which is threadably and adjustably engaged with stem 7, has been adjusted such as to raise member 22 to the up position as shown. Stem sections 7 and 42 have been telescopically extended by exerting lifting pressure on hand grasp 1. The sliding fits between members 7 and 42, 42 and 52 may be constructed to provide interference fitting when fully extended thereby holding the upper structure including member 22, in the up position ready for equipment insertion. Skis 6 and poles 10 are now installed into ski receiving chambers 3 and 9 respectively followed by the installation of boots 41 thereby creating the typical carrying and securing posture of FIG. 6. Member 17 is adjusted downward by means of its threadable and adjustable engagement with stem 7. Member 22 has pressure applied to the toe of boot 41 thereby causing its heel to apply pressure to the top surfaces of skis 6 and poles 10. The equipment now in proper installed position, the user may insert locking cable (not shown) into locking opening 19, thus securing device 40 and the members thereof. Observe that a locking cable is not absolutely essential since a suitable non locking securing pin may be attached to member 22 for ready insertion into opening 19 to prevent rotation of member 17.

EXAMPLE 3

FIGS. 7, 8 and 4 illustrate device 40 utilized as device 53 for carrying and securing skis 6 and poles 10 without boots 41. Starting with device 40 in the posture of FIG. 3, the skis 6 and poles 10 may be installed within the ski and pole receiving chambers 3 and 9. A slight downward pressure on hand grasp 1 will cause telescoping stems 7 and 42 to be retracted and thereby allowing members 21 to communicate down into ski housing 4 between side walls 11. Thus the compression pads 14 are now urged slightly down upon poles 10 and skis 6. Thereby securing same to device 53. This urging is achieved by turning member 17 into threaded engagement with member 2 and continued therewith until the proper pressure has been achieved. A locking cable may now be installed in opening 19 thereby securing device 53 and the members thereof.

Although the present invention, device 40, has been illustrated and described herein for use in carrying and securing ski equipment, it is evident from a broader standpoint, that the purpose of device 40 is to carry and secure equipment of the nature illustrated whether it be ski equipment, hunting equipment, fishing equipment, mountain climbing equipment industrial safety equipment, or some form of special tools and equipment associated with a particular job specialty. It should be understood, therefore, that it is not intended to limit the principles of the present invention to ski equipment alone, but rather to equipment according to the utilization principles of the present invention for various other uses, all of which are fully contemplated according to the present invention. coming now to the advantages of the present invention and, thus, according to the principles of the device 40, a unique means for carrying and securing ski equipment is obtained. First, the capability of carrying and securing skis, poles and boots in a single device.

Secondly, the capability of carrying and securing skis and poles without boots in the same device.

Thirdly, virtually foolproof adjustment means due to the simplicity thereof. Fourth, trouble-free service assured for repeated operation and usage. Fifth, enhanced safety to both user and others because device 40 allows the equipment to be conveyed with its center of gravity below the users center of gravity thereby creating ultimate stability under conditions otherwise extremely hazardous. Sixth, equipment may be stored in one single device having attractive, streamlined posture profile for convenient placement not otherwise possible. Seventh, this single device achieves what conventionally cannot be achieved in two separate devices since the commercially available boot tree does not provide securing means. Moreover, this is achieved by using a device 40 whose geometric size is substantially equivalent to the simplest of the only known commercially available boot tree.

Adjustable Locking Mechanism

It has been pointed out that one of the objects of this invention was to provide in one single device the functional characteristics of carrying and securing simultaneously not only poles and skis but also boots while maintaining the optional feature of carrying and securing any combination of equipment. Such a structure in one form has been shown in FIGS. 1, 2, 3, 4, 6, 7 and 8. Wherein stem 7 carries an axially threadably engaged boot toe retainer mechanism 59 (upper body portion) comprised of basic elements 22 and 17 which are further cooperatively engaged with one another. The boot toe retainer 22 has two similar oppositely disposed projections which are generally integumental to the boot toe configuration. A central connector means, adjusting and locking member 17, being located and inserted through a suitable aperture 57 formed substantially centrally of the oppositely disposed projections 22. These boot toe projections 22 may be formed integral with the main body of 22 substantially as shown in FIG. 1 or may be arcuately skeletonized using metal or nonmetal wire. Stem 7 telescopically cooperates with the lower body portion 58, comprising substantially the pole and ski housing 4, by means of telescoping structural members 7 and 42 both of which are respectively disposed within the other and each formed with extension limit mean generally at 47 and 48 as shown in FIG. 1. Member 22 is preferably formed as a unitary body molded from a suitable plastic and being generally rectangular in configuration having a lower outer, downwardly depending, generally cylindrical skirt 21, the interior of which is formed with a central passage 51 for receiving a counterbored generally, cylindrical member 17 provided with a threaded engagement to stem 7 and threaded or equivalent means for detachably connecting member 17 to mid-body upstanding central portion 2. Consequently, the combined cooperative functions of member 7, 17, 22, 42 and 2 provide the important features of construction necessary for compactness, simplicity, rugged, light weight and uniquely adaptable to the device 40 of FIGS. 3 and 6 and device 53 of FIGS. 4, 7 and 8.

Size

The improved device 40 construction discussed is particularly suitable to portable equipment such as skis, poles and boots since it permits the manufacturer of a standard compact structure having dimensions in the order of 18"×6"×6" and of a geometric configuration whereupon its utilization results in much less space being occupied by the total equipment installed therein. A device built in accordance with the structure hereinbefore described will have approximately one fourth the number of parts found on one of the more simple of the nationally manufactured boot carriers and ski carriers. It follows, therefore, that this new device construction permits the manufacturer of a simpler and less expensive device to achieve more combined functions than has heretofore been known.

Thus, it will be recognized that I have herein described and illustrated a new and improved device for carrying and securing equipment such as skis, poles and boots having special adaptation and utility in conjunction with user activities in a ski resort environment. It will also be appreciated that a convenient adjusting and locking mechanism 17 and 54 is provided for ease and simplicity of operation. The locking means 19 is simple, readily engaged and disengaged, and structurally secure.

All in all, the features of my new and improved carrying and securing device bring forth an advancement in the art over prior known devices of this character while the utilization of structural components and configuration as described produce a synergistic utility effect resulting in improved life and ruggedness for a device of the character described. It will also be recognized and appreciated that the utility of the unique yet simple mechanism, particularly the rotatable parts thereof, eliminates the need for maintenance repairs and/or replacement of parts.

Interchangeable Equipment Retainer

It has been pointed out that one of the objectives of this invention was to provide a device 40 adaptable for carrying, securing, storing and/or displaying a variety of equipment such as skis, poles and boots. Such an interchangeable structure has been disclosed in FIGS. 1 through 17. Furthermore, FIG. 12 illustrates an equipment retainer formed to provide a pair of jaws 22 pivotally mounted to adjustable carrier 22A. When device 40 is used in retracted posture 53, as shown on FIG. 4, jaw retainers 22 may be communicated with equipment retainer slots 37.

Adjusting the Equipment Retainer

In the discussion with respect to the movement of equipment retainer 22 of FIGS. 1, 2, 3, 4, 7 and 8 details were set forth for controlling the movement of these elements together with means for securing these elements in a selected setting. In its simplest functioning embodiment, the equipment retainer 22 can be adjusted up or down simply by rotating adjustment means 17 with the fingers. Observe in FIGS. 3 and 4 that the circumference of member 17 projects slightly beyond the exterior structure of member 22 thereby providing a convenient exposure of member 17 for ready rotation with the fingers. Similar arguments can be set forth for the adjusting means 17 in FIGS. 9, 10, 12, 13 and 15.

The adjusting means of FIG. 14 provides for either rotation of stem 7 by turning hand grasp 1 or by rotation of member 24 or by rotation of member 22.

FIGS. 16 and 17 illustrate a different class of adjustment using simple ratchets 32 and pawls 28 to provide a means whereby force extended down on hand grasp 1 cause stem 7 to telescope into member 2. Stem 7 remains secured to member 7 until pawls 28 are manually released.

Resilient Surfaces

Another feature of this invention deals with the surfaces in contact with the equipment. FIGS. 2 and 3 illustrate yieldable or resilient surfaces 13 and 14 providing means for both protection of equipment surfaces and also adjustment means in cooperation with upper body 59 whereby a complete range of equipment sizes may be accommodated in the single standard device 40.

Spacing Considerations

Spacing considerations can be observed in FIGS. 9, 10, 11 and 12. Ski equipment 6 chamber will influence dimension T of FIG. 11 as T approaches U and O it becomes expedient to make T slightly greater than U thereby allowing boot 41 to be lowered down into ski housing body member 4. Thus the skis 6 and poles 10 will be placed along beside boots 41. With this type of arrangement stems 7 and 43 will preferably be circular in cross sections.

Preferred Construction

An object of the invention is to provide a device of the character shown which may be conveniently utilized to quickly install, carry, secure and remove any combination of equipment such as skis, poles and boots. The preferred construction embodies a pair of opposed body parts 58 and 59, one of which, at least, has adjustment means engageable with a structure 42 communicating between said body parts thereby resulting in a carrying and securing device 40 best illustrated in FIG. 6. While the particular information of the body part may be widely varied, as hereinbefore discussed, the characteristic and novel features can be observed in FIGS. 2, 3, 4, and 6. As generally shown, the complete assembly, FIG. 3, includes a two-part mounting means 40 consisting of a ski and pole housing part 58 (lower body) which is movably affixed to a support 42.

A cooperatively connectible and adjustable upper body part 59 is extended from support 42 thus providing both carrying means 1 and equipment adjustable retainer means 22. The lower body part 58 comprises a central passage 52 extending completely therethrough with its lower most section thereof being slightly larger at 52 to receive limit stops 48. Stops 48 may be a circumferential boss or segmented lugs cooperating with axially located slots in passage 52 thereby preventing rotation of carrying handle 1. The passage 52 allows stem section 42 to extend and retract plus providing means for initial installation and assembling. The upper section of passage 52 is slightly smaller thereby providing a shoulder for limiting the upward movement of limit stops 48. The upper part of passage 52 has an external neck 2 which is threaded for cooperative arrangement with the internal counterbored and threaded section 51 of adjusting means 17.

The lower section of lower body 48 housing 4 defines a pair of horizontal passages separated by the central structure which encompasses passage 52. In operation, a pair of skis 6, or the like are installed therein. The upper section of lower body 58 defines a slightly outwardly contoured passage for installation of a pair of poles 10. The extreme upper parts of lower body side walls 11 are contoured for cooperative communication with the lower part of equipment 41 thereby preventing the removal of skis 6 and poles 10 when equipment 41 is installed therewith device 40. Turning now to FIGS. 4 and 8, it is further illustrated that lower body 58 cooperates with upper body skirt ski and pole retainer 21 thereby preventing the removal of skis 6 and poles 10 when equipment 41 is not installed therewith device 40 thus resulting in device posture 53 of FIG. 4.

Structural and Esthetic Construction Features

With reference to FIGS. 3, 4 and 10 it is seen that a generally circular structural configuration has been illustrated. It is, however, within the scope of this invention to provide a generally rectangular configuration contoured to follow the general pattern of part 22.

Skeletonized Construction Techniques

Manufacturing techniques combined with materials selected for construction can influence the cosmetic appearance, weight, economy and strength of the various parts and complete assembly 40. For instance, using plastic molding techniques could result in using a variety of ribs and open spaces merely to achieve strength, use of less materials and more efficient fabrication procedures. The utilization of metal wire forming, sometimes referred to as skeletonizing, provides an attractive manufacturing means. This technique generally requires that the wire be formed to the perimeter contour of device 40 and because of its greater strength than nonmetals, a skeleton structure results rather than a solid type structure.

Engineering properties, such as shear strength, yield, tensil strength, poisson's rates, fatigue strength, corrosion resistance, directionality are important considerations which, when considered together with the fabrication tooling techniques can have an influence upon the exterior appearance of device 40 while at the same time retaining the novel characteristics of the invention described hereinbefore. Often the outside configuration and dimensions of a part, such as device 40, are a function of its intended use and the designer has designed freedom either on the inside or the outside. The highly important choice of wall thicknesses has to be made carefully because of the ramifications involved. There are two conflicting considerations governing the initial choice of wall thickness. To obtain the maximum stiffness in a part, the choice will be the greatest wall thickness in combination with the lowest density. This is because the moment of inertia which determines stiffness and modules of elasticity, is a cube function of the thickness.

Therefore, it will be understood that while I have herein shown and described the features and improvements of my invention as related to preferred embodiments thereof, it is fully contemplated that various changes, modifications and substitutions of equivalents may be made therein without departing from the spirit and scope of my invention. Consequently, I do not wish to be limited to the specific illustrative embodiments herein described except as may appear in the following appended claims.

I claim:

1. A device for carrying and/or securing any desired combination or individual units of equipment such as skis, poles and boots, comprising, a lower body portion cooperating with a relative separable upper body portion for selective adjustable separation, said body portions being connected by means of an upstanding centrally disposed stem section having said upper body portion adjustably engaged thereto and a hand grasp coupled to a top end of said stem section, said upper body portion having operable means rotatable in a first direction for increasing said separation and in a second reverse direction for decreasing said separation, a pair of oppositely disposed boot toe retaining means associated with said upper body portion, said lower body portion enclosing a pair of ski and pole receiving chambers which diverge generally outwardly from within said lower body, said upper body having a skirt portion for cooperating with said ski and pole receiving chambers, and means associated with said upper body portion for releaseably and adjustably securing said separation at a selected location corresponding to the size of equipment installed therein.

2. The device as defined in claim 1 wherein said upper body is operatively connected to said stem section for axial movement relative thereto, said operative connection effectuating the movement of a boot retainer member into engagement with equipment for controlling the position of said equipment and its consequential engagement with said lower body portion.

3. The device as defined in claim 1 wherein said upper body is operatively connected to said stem section for axial movement relative thereto, said operative connection effectuating the movement of an upper body portion into engagement with equipment for controlling the position of said equipment relative to said lower body portion, the consequential engagement providing a device for carrying and securing said equipment being assembled therewith.

4. The device as defined in claim 1 wherein said operative connection to said stem section is comprised of a rotatable adjusting means threadably secured to said stem section and simultaneously cooperating with said upper body portion whereby upon manual manipulation of said rotatable adjusting means said upper body portion is thereby moved to a selected position relative to said lower body portion, said stem section further provided with a longitudinal slot cooperating with openings disposed in said upper body portion thereby providing for locking and securing said device.

5. The device as define in claim 1 whose ski and pole receiving chambers are generally covered with yieldable or resilient means.

6. The device as defined in claim 1 whose upper body portion is disposed with a lower skirt member having a bottom surface generally covered with yieldable or resilient means.

7. The device as defined in claim 1 whose stem section is generally rectangular in cross section and telescopically engaged with said lower body portion, said upper body portion having means for securing said upper body portion to said lower body portion.

8. The device as defined in claim 1 whose stem section is generally circular in cross section and telescopically engaged with said lower body portion, said upper body portion having means for securing said upper body portion to said lower body portion.

9. The device as defined in claim 1 whose stem section is generally rectangular in cross section and threadably engaged with a concentric rotatable adjusting means, said adjusting means cooperating with said upper body portion whereby upon manual rotation of said adjusting means said upper body portion is moved into a selected position relative to said lower body portion.

10. The device as defined in claim 1 wherein said stem section is telescopically engaged with said lower body portion.

11. The device as defined in claim 1 wherein said stem section is threadably engaged with said lower body member.

12. The device as defined in claim 1 wherein said stem section is engaged with said upper body portion by means of a tooth rack engaged with a rotatable externally threaded nut cooperating with said upper body portion such that rotation of said threaded nut moves said upper body portion into selected position relative to said stem section.

13. The device as defined in claim 1 wherein said stem section is adjustably engaged to said lower body portion by means of pawl and ratchet teeth.

14. In a device for carrying equipment such as skis, poles and boots, a pair of chambers for supporting a pair of skis and embodying a structural member disposed intermediate said chambers, a manipulatable upper body including boot retention members, said manipulatable upper body threadably engaged to a vertical projection from said structural member, said projection generally symmetrical with respect to said pair of chambers, said upper body adjustable to communicate with said boot toes for applying retention pressure along the longitudinal axis of said boot soles causing said boot heels to exert retention pressure onto upper surfaces of said poles and skis, the consequential results providing a single means for carrying and securing said equipment.

15. The device defined in claim 14 utilized to carry skis and poles without boots, wherein said upper body portion is adjusted to communicate with said pair of chambers, said upper body further threadably engaged with said vertical projection from said structural member thereby securing said skis and poles therewith.

16. An equipment carrier assembly of the class described for use with, any combination of skis, poles and boots, comprising in combination, a hand grasp, housing means carried at one end of a centrally located stem section; a pair of oppositely disposed longitudinal chambers in said housing means opening convergingly outward and adapted to receive skis and poles, a manipulatable and adjustable upper body member moveably engaged to said stem section, such movement occurring between a position substantially above said housing and a position slightly below said hand grasp, manually actuated adjustment means simultaneously engaged with said stem section and an equipment retaining means and moveable along the formers longitudinal axis, movement of said adjustment means serving normally to move said equipment retaining means against the upper terminus end of said equipment thereby applying a slight force therewith urging said equipment downward into cooperative communication with said lower body chambers, the consequential resultant actuation of said device effectuating the securing of said equipment with said carrier assembly.

17. The assembly as defined in claim 16 wherein said stem section comprises a telescopic engagement means with said housing means.

18. The assembly as defined in claim 16 wherein said equipment retaining means comprises a pair of oppositely disposed equipment holding means integral with said upper body, said body having a top wall and four side walls with a receiving chamber centrally located for containing said manually actuated adjustment means.

19. The assembly as defined in claim 16 wherein the said housing chambers have resilient surfaces serving to accommodate varying width and thickness skis and varying diameter poles.

20. Means for assemblying, carrying and, or, securing any combination of object such as skis, poles and boots or the like comprising:

a pair of cooperable body member retaining means including means for releasably engaging and securing any desired combination of said objects;

stem section means telescopically interconnecting said cooperable retaining means in a mutually aligned and predetermined relationship;

operating means rotatably mounted with one of said retaining means for selectively adjusting said retaining means parallel to the longitudinal axis of said telescopic interconnecting means;

means communicating with said rotatably mounted means for engaging a locking cable therewith whereby said objects are controlled to prevent unauthorized removal; and means disposed at the upper terminus of said telescoping interconnecting means for hand grasping and carrying;

the consequential operation of said means with said objects thereby providing means for carrying and, or, securing said objects.

21. The assembly as defined in claim 20 wherein a first of said pair of body members comprises a first resilient means for yieldably exerting a force on said equipment in response to action of said operating mechanism effectuating moving said first body member.

22. The assembly as defined in claim 21 wherein a second of said pair of body members comprises a second resilient means activatable to urge said equipment in opposition to said first resilient means at an increase in force level with respect thereto so that said equipment is displaced from an initial installed position to its final position upon operation of said operating mechanism.

23. The assembly as defined in claim 22 wherein at least one of the body members are adjustably engageable when the said assembly is mutually aligned in a predetermined relationship, engagement of said members being controlled by the position of said operating mechanism and said stem section, means connecting said body members with said operating mechanism so that relative adjustment of said members urges said equipment into controlled position enabling said assembly to carry and secure said equipment.

24. A device of the character described comprising cooperable body portions telescopically connected by means of a centrally located stem, at least one of said body members provided with adjustment and locking means, said adjustment and locking means functioning to selectively adjust said body portions into cooperative relationship with the consequential operation of said device providing for the assembly, carrying and, or, securing of any desired combination of equipment such as skis, poles and boots or the like.

25. A device of the character described comprising a pair of interconnected body members mutually aligned in a predetermined relationship for telescopic adjustment about a centrally disposed stem movably adjusted to each of said body members, the position of said members being controlled by the manipulation of an adjusting and locking member rotatably supported by one of said body members and linearly adjustable along the longitudinal axis of said stem, means cooperating with said adjusting and locking member whereby the consequential operation of said device provides the means for assembling, carrying and, or, securing any combination of equipment such as skis, poles and boots or the like.

26. A method for carrying and, or, securing any desired combination of objects such as skis, poles and boots as one assemblage comprising the steps of:

providing a device with telescopically interconnected body members dimensionally configured to releasably retain selectively in combination or individually a pair of skis, poles and, or boots unidirectionally oriented with the boots juxtapositioned above said skis and poles;

providing manipulatable adjusting and locking means in cooperative relation with the interconnected body members thereby adapting the device to accomodate objects such as skis, poles and boots, of different sizes;

carrying, and, or securing the objects with the device by manipulating the adjusting and locking means into selective releasable engagement with any desired combination of said objects; and optionally locking the device to prevent unauthorized removal or theft.

27. A carrying and securing device comprising cooperable skis, poles and boots engaging parts symetrically disposed and adjustably connected to a centrally located telescopically movable stem member, first of said parts has ski and pole receiving chambers and a pair of oppositely disposed boot retainer means, second of said parts has adjusting and locking means rotatable supported by a boot retainer part, said second part further adjustably connected to said stem member whereby when the first part is moved into a mutually aligned predetermined relationship with said second part any desired combination of skis, poles and boots, or the like, may be assembled with said device and carried and, or, secured against unauthorized removal.

28. A two part telescopically connected carrying and, or, securing means for any combination of objects such as skis, poles and boots, comprising: a first part including means for carrying objects such as skis and poles, a vertically projecting and centrally located telescopic stem member, and a pair of symmetrically located means for retaining objects such as boots; a second part adjustably connected for movement along the longitudinal axis of said stem member, said second part cooperating with said first part such that the consequential results is a multi function device for assembling, carrying and, or, securing any desired combination of objects such as skis, poles and boots.

29. In a method of selectively assembling any combination of equipment such as skis, poles and boots for conveying and, or, securing as a single integral unit comprising the steps of:

a. positioning a pair of skis and poles into receiving chambers located symmetrically relative to a central telescopic stem member, and b. positioning a pair of boots into cooperable engagement with oppositely disposed and symmetrically related boot retainers, and c. manipulating an adjusting and locking member thereby causing said boots to be releasably engaged into cooperative relationship with said skis and poles thereby causing said skis, poles and boots, or the like, to be releasably retained, and d. optionally connecting a locking cable therewith thus causing said assembly of equipment to be secured against unauthorized removal, and e. removal of said equipment, when desired, by reverse performance of the steps in d, c, b, and a above.

* * * * *